US009679523B2

(12) United States Patent
Lee et al.

(10) Patent No.: US 9,679,523 B2
(45) Date of Patent: Jun. 13, 2017

(54) CONTROLLER FOR PERSISTENT DISPLAY PANEL WITH SIMD MODULE THAT TRANSPOSES WAVEFORM DATA

(71) Applicants: Wai Hung Lee, Hong Kong (HK); Mingle Sun, Shanghai (CN)

(72) Inventors: Wai Hung Lee, Hong Kong (HK); Mingle Sun, Shanghai (CN)

(73) Assignee: NXP USA, INC., Austin, TX (US)

( * ) Notice: Subject to any disclaimer, the term of this patent is extended or adjusted under 35 U.S.C. 154(b) by 160 days.

(21) Appl. No.: 14/695,053

(22) Filed: Apr. 24, 2015

(65) Prior Publication Data

US 2016/0171922 A1 Jun. 16, 2016

(30) Foreign Application Priority Data

Dec. 15, 2014 (CN) ..... 2014 1 0858356

(51) Int. Cl.

| | |
|---|---|
| ***G09G 3/20*** | (2006.01) |
| ***G09G 5/00*** | (2006.01) |
| ***G09G 3/34*** | (2006.01) |
| *G09G 3/14* | (2006.01) |

(52) U.S. Cl.

CPC ..... *G09G 3/344* (2013.01); *G09G 3/14* (2013.01); *G09G 2310/0205* (2013.01); *G09G 2310/04* (2013.01); *G09G 2320/0252* (2013.01); *G09G 2320/0285* (2013.01); *G09G 2320/10* (2013.01); *G09G 2340/16* (2013.01)

(58) Field of Classification Search

CPC ..... G09G 3/344; G09G 2340/16; G09G 2320/10; G09G 2310/04; G09G 2320/0252; G09G 2320/0285; G09G 3/2007; G09G 2310/06

USPC ..... 345/545, 629, 204, 208, 211, 212

See application file for complete search history.

(56) References Cited

U.S. PATENT DOCUMENTS

| | | | | |
|---|---|---|---|---|
| 5,392,385 | A * | 2/1995 | Evangelisti | G06T 15/503 345/441 |
| 7,511,722 | B1 * | 3/2009 | Ollmann | G06T 3/606 345/568 |
| 8,730,152 | B2 | 5/2014 | Hare et al. | |

(Continued)

OTHER PUBLICATIONS

W.-C. Kao, "Electrophoretic Display Controller Integrated with Real-Time Halftoning and Partial Region Update", Journal of Display Technology, vol. 6, No. 1, Jan. 2010, pp. 36-44.*

*Primary Examiner* — Jin-Cheng Wang

(74) *Attorney, Agent, or Firm* — Charles E. Bergere

(57) ABSTRACT

A controller for a persistent display device has an overall table of waveform data corresponding to different transitions of pixels from all pixel states to all others for differing operating parameters. A hardware LUT module receives input values containing new and current pixel state data and indexes to identify update requests, stores in LUT table memory space mapping values that are segments of waveform data generated in run time according to the operating parameters of each update request, and places segments of waveform data corresponding to the update requests into LUT output memory space. A SIMD module transposes waveform data of the update requests from the LUT output memory space, and places the transposed waveform data in respective frame scan buffers. An interface receives the transposed waveform data for the display device to update an image displayed on the panel.

11 Claims, 3 Drawing Sheets

(56) References Cited

U.S. PATENT DOCUMENTS

| | | | | |
|---|---|---|---|---|
| 2012/0147016 | A1* | 6/2012 | Ishikawa | G06T 1/20 345/505 |
| 2012/0188272 | A1* | 7/2012 | Wang | G09G 3/344 345/629 |
| 2012/0229436 | A1* | 9/2012 | Rhodes | G09G 3/344 345/211 |
| 2014/0285479 | A1* | 9/2014 | Yamada | G09G 3/344 345/212 |
| 2015/0371602 | A1* | 12/2015 | Muto | G09G 3/04 345/208 |
| 2016/0004293 | A1* | 1/2016 | Park | G06F 1/3265 345/208 |

* cited by examiner

CONTROLLER FOR PERSISTENT DISPLAY PANEL WITH SIMD MODULE THAT TRANSPOSES WAVEFORM DATA

BACKGROUND OF THE INVENTION

The present invention is directed to integrated circuits and, more particularly, to a controller for a persistent display panel.

Persistent display panels are widely used in e-readers, for example. An e-reader is a portable battery-powered electronic device that is particularly adapted to reading text, with or without pictures. An e-reader has good readability in bright ambient light, even sunlight. The power consumption is very low, giving long battery life between recharging. Some e-readers have a battery life of one to two months before recharging.

For displaying video or games, for example, the frame displayed is refreshed continuously at a rate of 50 Hz to 200 Hz or more to display motion pictures. In an e-reader, however, the image of the page displayed is static and does not change while the page is read. Updating continuously the page to be displayed in an e-reader at such a fast frame refresh repetition rate is unnecessary. A persistent display panel is not well suited to displaying motion pictures but is well adapted to displaying the static image of a page in an e-reader. Persistent display panels have low power consumption while the image is unchanged, which is an important advantage in an e-reader.

A commonly used technology for a persistent display panel is e-paper, which electronically generates an image comparable to a traditional printed ink paper. The image reflects ambient light giving high contrast and a wide reading angle. An example of e-paper technology is an electrophoretic display (EPD), which can hold an unchanging image of text or a picture almost indefinitely with negligible power consumption. An EPD panel has pigmented particles in suspension, usually in micro-capsules between two plates bearing arrays of electrodes. Voltages applied to the electrodes produce electrical fields of pixel size that re-arrange the pigmented particles to update the displayed image.

The image on a persistent display panel can persist for long periods, hours or even days, in the absence of electric fields. However, building up the display of a new image can be slow, and a ghost of the previous image may persist after the frame is updated. A common technique for reducing these concerns is to apply voltages many times during the frame refresh, that is to say the image update.

The successive voltages (waveforms) applied to any given pixel during the frame refresh are a function of the previous state of the pixel, its current transitional state, and its intended new state. Commonly, the waveforms are functions of the temperature of the EPD, which is sensed and serves as a parameter in deriving the waveforms. The waveforms may also be different for different modes of frame refresh, for example initialization, in which any image persisting on the panel is cleared, monochrome, which displays a black-and-white image, gray-scale mode, which is commonly used, and full color mode, which is not widely used yet.

Increasing resolution and screen size of e-reader panels increase the amount of data to process in producing the frame refresh waveforms. Typically, a central processor unit (CPU) extracts pixel data for the image content from memory and loads the relevant pixel data into pixel buffers. A conventional approach uses a dedicated hardware controller that receives the pixel data from the pixel buffers and provides waveform data to drivers that generate the waveforms for the display panel. However, since the hardware controller is specific to the e-reader that it is used with, incompatible applications cannot use it, making a dedicated hardware controller a costly solution.

It is possible to convert pixel data to waveform data using software. However, the quantity of data to be processed, especially for high resolution and large screen sizes makes the frame refresh too slow.

Thus, it would be advantageous to have a controller for a persistent display panel that is less inflexible than a hardware controller, while offering high speed frame refresh.

BRIEF DESCRIPTION OF THE DRAWINGS

The present invention, together with objects and advantages thereof, may best be understood by reference to the following description of embodiments thereof shown in the accompanying drawings. Elements in the drawings are illustrated for simplicity and clarity and have not necessarily been drawn to scale.

DETAILED DESCRIPTION

Figure 1:
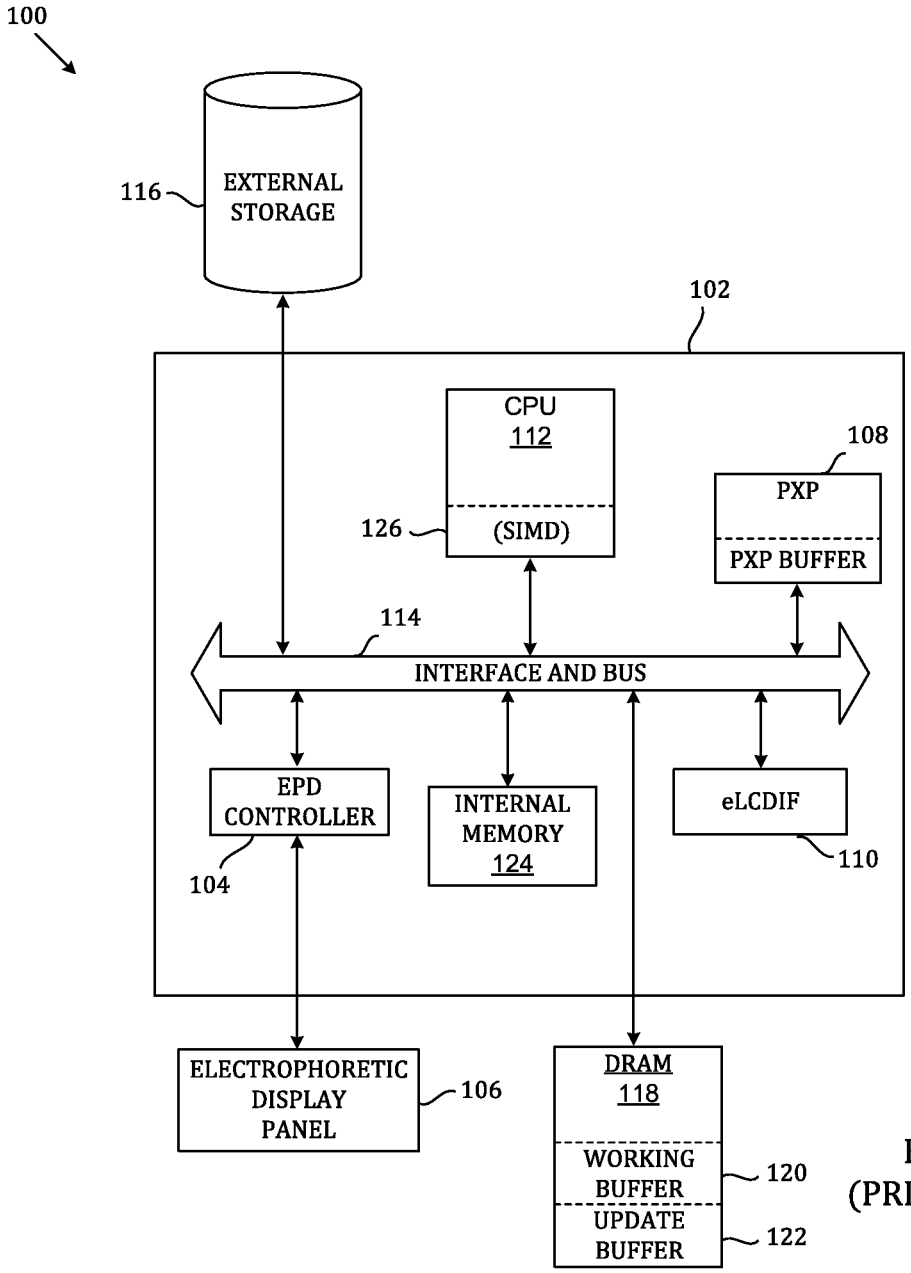
FIG. 1 (PRIOR ART)
FIG. 1 is a schematic block diagram of a display system having a persistent display panel and a conventional dedicated hardware controller.
Figure 2:
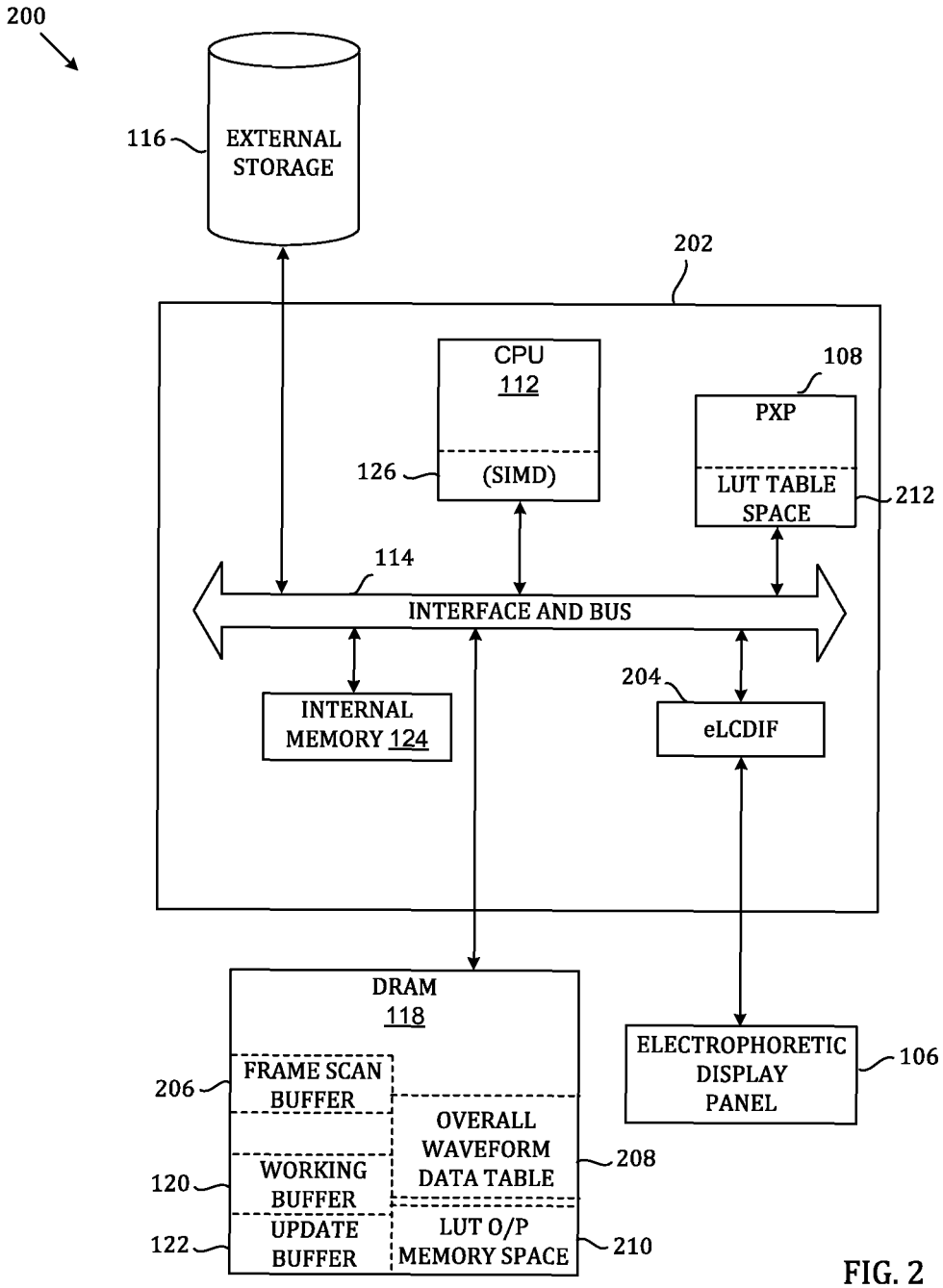
FIG. 2 is a schematic block diagram of a display system having a persistent display panel and a controller, in accordance with an embodiment of the invention, given by way of example.
Figure 3:
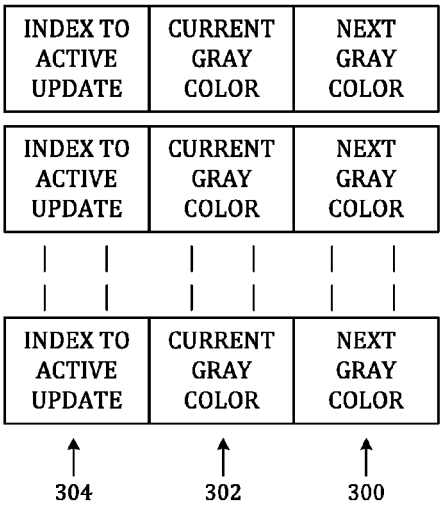
FIG. 3 is a block diagram showing the structure of pixel data entering into a hardware lookup table in the display controller of FIG. 2.

FIG. 1 shows a conventional display system 100. The system 100 has a multimedia applications processor 102 that includes a dedicated hardware direct-drive active matrix EPD controller 104 that is specifically designed to drive an eReader persistent display device 106 having an E•INK™ electrophoretic display (EPD) panel. The processor 102 also includes a pixel processing pipeline (PXP) 108, and an integrated extended liquid crystal display interface (eLCDIF) controller 110 for an LCD panel. The processor 102 can be used in a wide variety of general embedded applications. A central processor unit (CPU) 112 drives the EPD controller 104, the PXP 108 and the eLCDIF controller 110 through an interface and bus 114. Content to be displayed can be stored in external memory 116 and down loaded to dynamic random access memory (DRAM) 118 including a working buffer 120 containing pixel data for the currently displayed image and an update buffer 122 containing pixel data for the next image to be displayed. The DRAM 118 may be on a different chip from the processor 102, which typically also includes internal memory 124. The processor 102 also includes interfaces (not shown) for connecting peripherals such as wireless local area networks (WLAN), Bluetooth™, GPS, camera sensors, and multiple displays.

The CPU 112 has a single-instruction, multiple-data (SIMD) module 126 that can be used as a media processing engine for instructions for different requirements, such as audio, video, 3-D, graphics, image, and speech processing. The PXP 108 is a hardware lookup table (LUT) that can be used to process graphics data or composite video and graphics data before sending such data to an LCD display or TV encoder. The PXP 108 is capable of scaling, color space conversion (CSC) between YUV and RGB color spaces, and alpha-blending.

FIGS. 2 to 6 illustrate a display system 200 in accordance with an embodiment of the present invention. The system 200 includes some of the same components as the system 100, which are identified using the same element numbers. The display system 200 has a persistent display device 106 and a controller 202 in accordance with an embodiment of the invention.

The controller 202 comprises a central processing unit (CPU) 112 for providing new pixel state data in an update buffer 122, current pixel state data in a working buffer 120, and current operating parameters. A memory 118 stores an overall table 208 of waveform data corresponding to different transitions of pixels from all pixel states to all other pixel states according to different operating parameters.

A hardware lookup table (LUT) module 108 receives input values containing new pixel state data 300 (FIG. 3), current pixel state data 302 and indexes 304 allocated by the CPU 112 to identify a plurality of update requests #X to #(X+N) for respective groups of pixel locations in the panel in parallel.

The LUT module 108 has LUT output memory space 210 and LUT table memory space 212. The LUT table memory space 212 stores mapping values 400 (FIG. 4), which are segments of waveform data generated from the overall waveform table 208 at run time according to the operating parameters of each update request #X to #(X+N). The LUT module 108 places segments of waveform data corresponding to the update requests #X to #(X+N) from the LUT table memory space 212 into the LUT output memory space 210.

Figure 5:
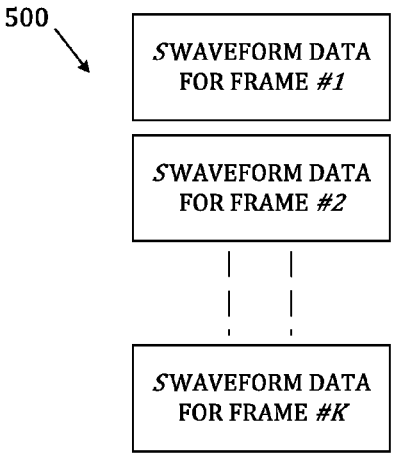
FIG. 5 is a block diagram showing the structure of waveform data in frame scan buffers in the display controller of FIG. 2.

A single-instruction multiple-data (SIMD) module 126 transposes the segments of waveform data from the LUT output memory space 210, and places the transposed waveform data 500 in respective frame scan buffers 206 (FIG. 5). An interface 204 receives the transposed waveform data 500 for the display device 106 to update an image displayed on the panel.

The capacity of the LUT module 108 is insufficient to store the waveform data corresponding to the overall table 208 of all different transitions of pixels from current pixel states to other new pixel states according to different operating parameters, which may be of the order of 1 MByte for a 16-grayscale panel. The controller 202 breaks down the waveform data at run time to mapping values 400 that fit in the LUT table memory space 212 of the LUT module 108 for concurrent updates of groups of pixels. Pixels for a given update request will use the same operating parameters. Update requests #X to #(X+N) represent N update requests submitted in a period of time. The operating parameters of these requests may or may not be the same.

The current operating parameters that the CPU 112 provides may include operating temperature common to concurrent updates, and specific update mode and waveform mode for individual updates. These parameters are combined with a frame count to construct the mapping values 400 that are written to the LUT table memory space 212. The frame count is increased as the update process progresses.

The LUT module 108 may be a pixel processor PXP.

The SIMD module 126 may transpose the data in the LUT output memory space 210 to the format of the waveform data 500 corresponding to the LUT input values 300, 302, 304 for the update requests #X to #(X+N) and writes the transposed data into individual frame scan buffers 206. The process is much faster than a software extraction of the waveform data for each pixel.

The CPU 112 may provide the new pixel state data 300, current pixel state data 302 and allocate the indexes 304 for current updates to the LUT module 108. The new pixel state data 300 is first written to the working buffer 120, which contains current pixel state data 302 and indexes 304, and the LUT module 108 can then receive by direct memory access (DMA) the data from the working buffer 120, look up the mapping values 400 from the LUT table memory space 212 according to the LUT input values 300, 302, 304 and place them by DMA into the LUT output memory space 210 located in the DRAM 118.

Figure 6:
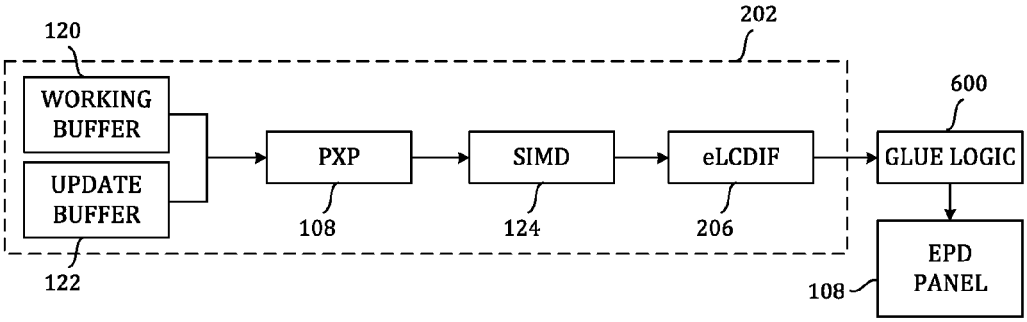
FIG. 6 is a chart showing the flow of data in the display controller of FIG. 2.

FIG. 6 illustrates the flow of data in an example of the controller 202 in more detail. The CPU 112 loads pixel content into the update buffer 122 and the working buffer 120. For each batch of concurrent pixel updates, the CPU 112 defines an update request and inputs to the LUT module 108 the new and current pixel state data 300 and 302 (4 bits each for a 16 grayscale image) and allocates free values of the indexes 304. For a maximum size of the input to the LUT module 108 of 13 bits, 8 bits are taken by the new and current pixel state data 300 and 302, leaving 5 bits for the indexes 304. The indexes 304 input to the LUT module 108 are able to identify 31 concurrent updates since one update index is reserved for pixels that are idle (inactive) and are not updated in the current frame update.

The bit stream of waveforms for the EPD is a sequence of 2 bits data, corresponding to positive voltages, negative voltages, and neutral voltage. The size of the output from the LUT module 108 will define the number of frame scan buffers that can be generated at once in the LUT module 108. As the bit stream of the waveform for the EPD is a sequence of 2 bits data, it can generate simultaneously 8 (denoted as F) frame scan buffers for a maximum size of the output to the LUT module 108 of 16 bits. If a pixel does not belong to any active updates, the corresponding mapping value at the output of the LUT module 108 is zero.

Figure 4:
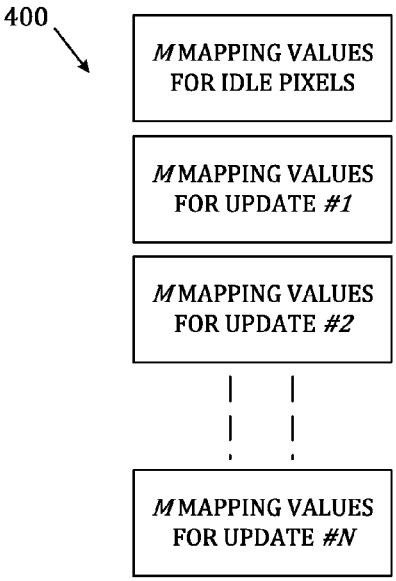
FIG. 4 is a block diagram showing the structure of mapping values written to a hardware lookup table in the display controller of FIG. 2.

As shown in FIG. 4, the memory containing the overall waveform table 208 is divided into sections of size 16*16=256 entries corresponding to all possible transitions of pixels from current pixel states to other new pixel states with given operating parameters. Each entry in a section contains a number F (8 in this example) of 2-bit data. A number N of sections are made available (plus a reserved section for idle pixels), corresponding to the number N of concurrent updates supported (31 in this example). The frame count is increased by F (8 in this example) after processing each segment of updates. The indexes 304 allocated identify the section whose data is to be chosen based on the transition from the current pixel state to the next pixel state and form the output of LUT module 108. The update is active as long as the frame count is less than the maximum frame count. At the same time, the output of the LUT module 108 is the input to the SIMD module 126. As shown in FIG. 4, when the frame count increases, the mapping values 400 written into the LUT module 108 will vary from segment to segment throughout the updates. The SIMD module 126 transposes the segments of waveform data from the LUT output memory space 210 to the format of a number F of the waveform data 500 (FIG. 5) contributing to a number K of the individual frame scan buffers 206. The number K of the individual frame scan buffers 206 is greater than (in this example twice) the number F of 2-bit data in segments of waveform data in the LUT output memory space 210 that can be generated concurrently so as to provide a buffer queue to an eLCDIF module 204. The waveform data 500 entered into the frame scan buffers 206 drives, through the eLCDIF module 204, the generation of voltages for updating all the pixels in the image of the EPD panel 106 whether the pixels are active or idle.

In an example implementation of the controller 202, the processing time for 8 individual frame scan buffers 206 with display resolution of 1440×1080 is 46 ms, leaving a margin relative to an equivalent frame refresh rate of 100 Hz. Glue Logic 600 is used to overcome incompatible active logic for some pins between the eLCDIF module 204 and the EPD panel 106. The glue logic 600 contains three inverters to convert three signals in the frame scan buffers 206 from active low to active high.

The invention may be implemented partially in a non-transitory machine-readable medium containing a computer program for running on a computer system, the program at least including code portions for performing steps of a method according to the invention when run on a programmable apparatus, such as a computer system or enabling a programmable apparatus to perform functions of a device or system according to the invention.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

In the foregoing specification, the invention has been described with reference to specific examples of embodiments of the invention. It will, however, be evident that various modifications and changes may be made therein without departing from the broader spirit and scope of the invention as set forth in the appended claims.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality. Similarly, any arrangement of components to achieve the same functionality is effectively "associated" such that the desired functionality is achieved. Hence, any two components combined to achieve a particular functionality can be seen as "associated with" each other such that the desired functionality is achieved, irrespective of architectures or intermediate components. Likewise, any two components so associated can also be viewed as being "operably connected", or "operably coupled", to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples of the controller 202 may be implemented as circuitry located on a single integrated circuit or within a same device. Alternatively, the modules of the controller 202 may be implemented as any number of separate integrated circuits or separate devices interconnected with each other in a suitable manner.

In the claims, the word 'comprising' or 'having' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A controller for a persistent display device that displays an image on a panel, the controller comprising:

a central processing unit (CPU) for providing new pixel state data in an update buffer, current pixel state data in a working buffer, and current operating parameters;

a memory that stores an overall table of waveform data corresponding to different transitions of pixels from all pixel states to all other pixel states according to different operating parameters;

a hardware lookup table (LUT) module for receiving LUT input values containing new pixel state data, current pixel state data, and indexes allocated by the CPU to identify a plurality of update requests for respective groups of pixel locations in the panel in parallel, and wherein the LUT module has LUT table memory space for storing mapping values that are segments of waveform data generated from an overall waveform table at run time according to the operating parameters of an update request, and LUT output memory space for receiving segments of waveform data corresponding to the update requests from the LUT table memory space;

a single-instruction multiple-data (SIMD) module for transposing the segments of waveform data from the LUT output memory space, and placing the transposed waveform data in respective frame scan buffers; and an interface connected to the scan buffers for receiving the transposed waveform data for the display device to update an image displayed on the panel, wherein the SIMD module transposes the data in the LUT output memory space to the format of the waveform data corresponding to the LUT input values for the update requests and writes the transposed data into the respective frame scan buffers.

2. The controller of claim 1, wherein the current operating parameters that the CPU provides include operating temperature common to concurrent updates and specific update mode and waveform mode for individual updates, and wherein the parameters are combined with frame count to construct the mapping values that are written to the LUT table memory space of the hardware LUT module, wherein the frame count is increased as the update process progresses.

3. The controller of claim 1, wherein the hardware LUT module is a pixel processor.

4. The controller of claim 1, wherein the CPU provides the new pixel state data, current pixel state data and allocates the indexes for current updates to the hardware LUT module.

5. The controller of claim 4, wherein the new pixel state data is first written to the working buffer which contains current pixel state data and indexes, and the hardware LUT module then receives by direct memory access (DMA) the data from the working buffer, looks up the mapping values from the LUT table memory space according to the LUT input values and places them by DMA into the LUT output memory space.

6. A display system comprising a persistent display device and the controller of claim 1.

7. A method of updating an image displayed on a panel of a persistent display device, the method comprising:

a central processing unit (CPU) providing new pixel state data in an update buffer, current pixel state data in a working buffer, and current operating parameters;

providing in a memory an overall table of waveform data corresponding to different transitions of pixels from all pixel states to all other pixel states according to different operating parameters;

receiving in a hardware lookup table (LUT) module LUT input values containing new pixel state data, current pixel state data and indexes allocated by the CPU to identify a plurality of update requests for respective groups of pixel locations in the panel in parallel, storing in LUT table memory space mapping values which are segments of waveform data generated from the overall waveform table in run time according to the operating parameters of each update request, and receiving in LUT output memory space segments of waveform data corresponding to the update requests from the LUT table memory space in the LUT output memory space;

transposing the segments of waveform data from the LUT output memory space with a single-instruction multiple-data (SIMD) module, and placing the transposed waveform data in respective frame scan buffers; and receiving in an interface the transposed waveform data for the display device to update an image displayed on the panel, wherein the SIMD module transposes the data in the LUT output memory space to the format of the waveform data corresponding to the LUT input values for the update requests and writes the transposed data into the respective frame scan buffers.

8. The method of claim 7, wherein the current operating parameters that the CPU provides include operating temperature common to concurrent updates and specific update mode and waveform mode for individual updates, and wherein these parameters are combined with frame count to construct the mapping values which are written to the LUT table memory space of the hardware LUT module, the frame count being increased as the update process progresses.

9. The method of claim 7, wherein the hardware LUT module is a pixel processor.

10. The method of claim 7, wherein the CPU provides the new pixel state data, current pixel state data, and indexes for current updates to the hardware LUT module.

11. The method of claim 10, wherein the new pixel state data is first written to the working buffer, wherein the working buffer contains current pixel state data and indexes, and the hardware LUT module then receives by direct memory access (DMA) the data from the working buffer, looks up the mapping values from the LUT table memory space according to the LUT input values, and places the mapping values by DMA into the LUT output memory space.

* * * * *